United States Patent [19]

Tanaka et al.

[11] 4,406,953

[45] Sep. 27, 1983

[54] TIMER SWITCH

[75] Inventors: Toshio Tanaka, Susono; Hiroshi Omata, Gotenba; Kuniaki Uno, Susono, all of Japan

[73] Assignee: Kabushiki Kaisha Higashifuji Seisakusho, Tokyo, Japan

[21] Appl. No.: 294,613

[22] Filed: Aug. 20, 1981

[30] Foreign Application Priority Data

| | | | |
|---|---|---|---|
| Aug. 25, 1980 | [JP] | Japan | 55-116863 |
| Dec. 29, 1980 | [JP] | Japan | 55-185170 |
| Dec. 29, 1980 | [JP] | Japan | 55-185171 |
| Dec. 29, 1980 | [JP] | Japan | 55-185172 |

[51] Int. Cl.[3] ..... H01H 7/00

[52] U.S. Cl. ..... 307/141; 200/38 A; 310/41

[58] Field of Search ..... 200/35 R, 35 H, 35 B, 200/35 EQ, 35 A, 35 W, 36, 37 R, 37 A, 38 R, 38 A, 38 F, 38 FA, 38 FB, 38 B, 38 BA, 38 C, 38 CA, 38 D, 38 DA, 38 DB, 38 DC, 38 E; 307/141, 141.4; 310/41

[56] References Cited

U.S. PATENT DOCUMENTS

| | | | |
|---|---|---|---|
| 2,603,725 | 7/1952 | Dietrich | 200/38 B |
| 3,917,917 | 11/1975 | Murata | 200/307 |
| 3,975,652 | 8/1976 | Hammond | 310/41 |

*Primary Examiner*—A. T. Grimley
*Assistant Examiner*—Morris Ginsburg
*Attorney, Agent, or Firm*—Darby & Darby

[57] ABSTRACT

A timer switch comprises a drive gear secured to an interval shaft rotatably mounted on a casing. A first clutch gear is rotatably mounted on a bushing which is rotatably mounted on said casing. The first clutch gear is in mesh with the drive gear. A second clutch gear is fixedly mounted on the bushing for rotation therewith and disposed in closely spaced opposed relation to the first clutch gear. The second clutch gear is operatively connected to an electric motor. A slip friction clutch in the form of a flat resilient plate is interposed between and frictionally engages the opposed first and second clutch gears so that the slip friction clutch is deformed into an arcuate cross-section. The slip friction clutch urges the first clutch gear away from the second clutch gear into frictional engagement with the bushing. Upon rotation of the interval shaft, the first clutch gear is rotated independently of the second clutch gear, frictionally moving relative to the slip friction clutch and the bushing whereas upon rotation of the motor, the slip friction clutch connects the first and second clutch gears for rotation in unison.

15 Claims, 22 Drawing Figures

TIMER SWITCH

BACKGROUND OF THE INVENTION

1. Field of the Invention

This invention relates to improvements in a timer switch.

2. Prior Art

One known timer switch 200 shown in FIG. 1 comprises a synchronous motor 201 in which a rotor, in the form of a permanent magnet having a multi-pole periphery, is rotated in synchronism with a rotating magnetic field caused by a toroidal coil or the like. An interval shaft 202 is journaled in a casing 203, and a bushing 204 is secured to a splined portion 202*a* of the shaft 202 for rotation therewith. A cam 205 of a disc shape is mounted on a reduced diameter portion or end portion 202*b* of the shaft 202. The bushing 204 has an integral key portion 204*a* through which it is keyed to the cam 205. A drive gear 206 is rotatably mounted on a central boss 204*b* of the bushing 204. The rotation of the motor 201 is transmitted to the drive gear 206 through a reduction gear train 208 comprising a plurality of gears $\mathbf{208}_1$ to $\mathbf{208}_n$, so that the cam 205 is rotated in sliding contact with one of electrical contact plates 209 of resilient material for switching electrical current after a preset time interval, as is well known in the art.

A slip friction clutch 207 is provided for rotating or angularly moving the cam 205 independently of the drive gear 206 when the interval shaft 202 is operated manually or otherwise mechanically for setting the timer switch 200. The slip friction clutch 207 comprises a leaf spring in the form of a disc having radially downwardly extending legs 207*a*. The shaft 202 extends through the leaf spring 207 at its center and is rotatable relative thereto. The leaf spring 207 acts between the stepped portion 202*c* of the shaft 202 and the drive gear 206 to urge the drive gear 206 into frictional engagement with the bushing 204. With this configuration of the leaf spring 207, however, its dimension in the axial direction of the interval shaft 202 is increased because of the provision of the radially downwardly extending legs 207*a*. As a result, the timer switch 200 could not be constructed in a compact manner. In addition, the leaf spring 207 could not be manufactured at low costs on account of such a complicated shape.

SUMMARY OF THE INVENTION

It is therefore a primary object of this invention to provide a timer switch having a slip friction clutch for selectively connecting first and second clutch gears, which timer switch is compact in construction and requires less torque for operating an interval shaft.

According to the present invention, there is provided a timer switch which comprises:

a casing;

an electric motor mounted on said casing an interval shaft mounted on said casing for rotation about its axis;

a cam of a generally disc-shape mounted on said interval shaft for rotation therewith;

an electrical switching means for switching electrical current including a plurality of resilient contact plates mounted on said casing, said cam acting on at least one of said contact plates;

a drive gear fixedly secured to said interval shaft for rotation therewith;

a bushing rotatably mounted on said casing;

a first clutch gear rotatably mounted on said bushing, said first clutch gear being in mesh with said drive gear;

a second clutch gear fixedly mounted on said bushing for rotation therewith, said second clutch gear being disposed in closely spaced opposed relation to said first clutch gear and being operatively connected to said motor; and a slip friction clutch comprising a flat resilient plate, said slip friction clutch being interposed between and frictionally engaging said opposed first and second clutch gears so that said slip friction clutch is deformed into an arcuate cross-section, said slip friction clutch urging said first clutch gear away from said second clutch gear into frictional engagement with said bushing;

whereby upon rotation of said interval shaft, said first clutch gear is rotated independently of said second clutch gear, frictionally moving relative to said slip friction clutch and said bushing whereas upon rotation of said motor, said slip friction clutch connecting said first and second clutch gears for rotation in unison.

Other advantages, features and additional objects of the present invention will become manifest to those versed in the art upon making reference to the detailed description and the accompanying sheets of drawings in which preferred embodiments incorporating the principles of the present invention are shown by way of illustrative examples. Like reference numerals denote corresponding parts in several views.

DESCRIPTION OF THE PREFERRED EMBODIMENTS

Figure 1:
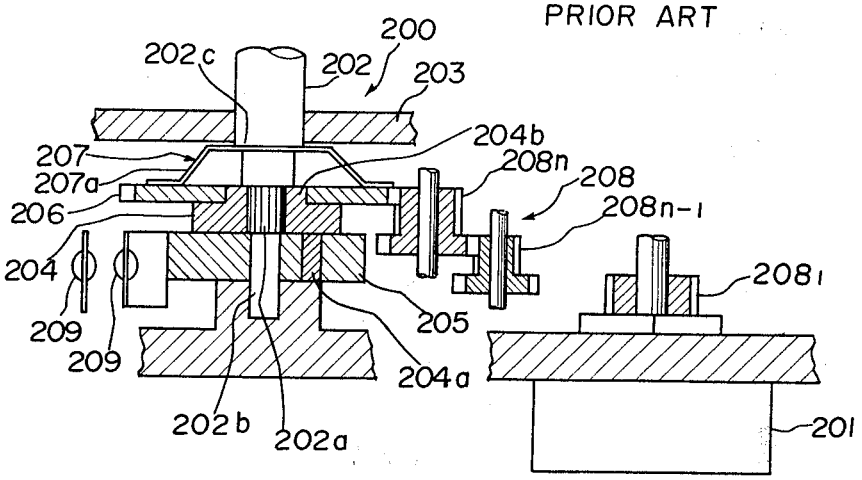
Fig. 1 PRIOR ART
FIG. 1 is a cross-sectional view of a timer switch provided in accordance with the prior art.
Figure 2:
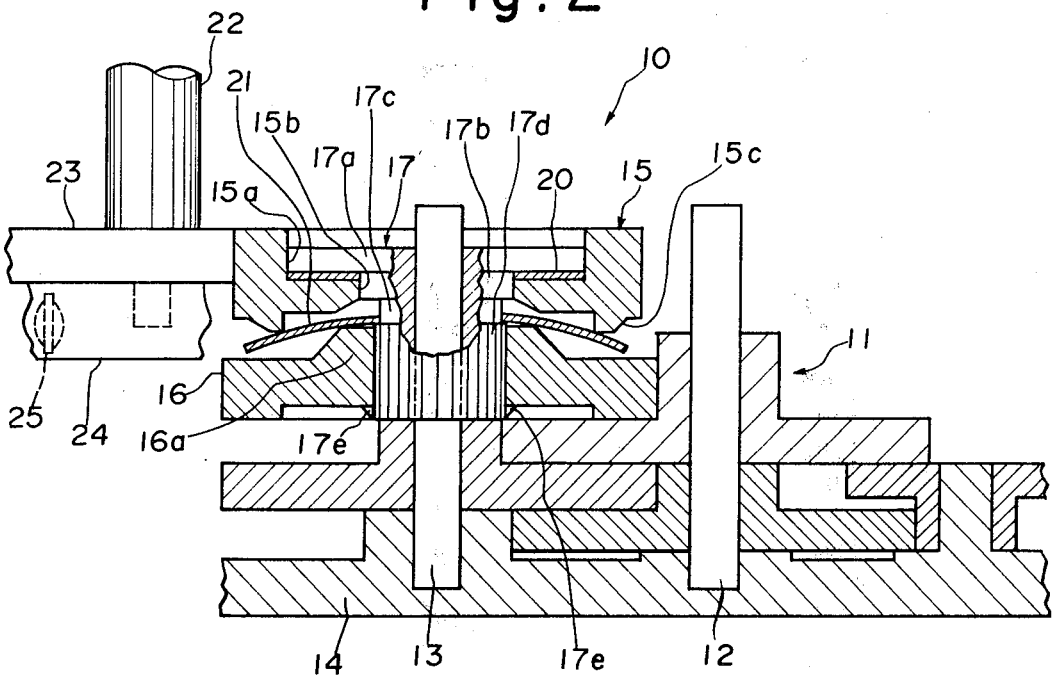
FIG. 2 is a cross-sectional view of a timer switch provided in accordance with the present invention.

FIG. 2 shows a timer switch 10 according to a first embodiment of the invention. The timer switch 10 comprises a reduction gear train 11 which includes a plurality of gears mounted on shafts 12 and 13 mounted on a casing 14. A pair of clutch gears 15 and 16 are mounted on the shaft 13 through a bushing 17. The bushing 17 is mounted on the shaft 13 and has a head portion 17*a* of enlarged diameter, first and second intermediate portions 17*b* and 17*c* and a splined end portion 17*d*. The clutch gear 15 has a bore 15*a* and a central aperture 15*b*. The head portion 17*a* is rotatably received in the bore 15*a*, and the first intermediate portion 17*b* is rotatably received in the central aperture 15*b*. A washer 20 is interposed between the head portion 17*a* and the clutch gear 15. The clutch gear 16 is fitted on the splined portion 17*d* of the bushing 17 for rotation therewith about the shaft 13. The lower end of the splined portion 17*d* is deformed or staked at several regions 17*e* to fix the bushing 17 relative to the clutch gear 15.

A slip friction clutch 21 is interposed between the opposed clutch gears 15 and 16, the clutch 21 comprising a resilient member of a disc shape which remains flat when subjected to no external force. The resilient member 21 is held in frictional engagement with an annular flange 15*c* of the clutch gear 15 and a central circular boss 16*a* of the clutch gear 16. The central boss 16*a* is disposed within the annular flange 15*c* in concentric relation thereto. With this arrangement, the resilient member 21 is deformed into a cross-sectionally arcuate shape, so that the clutch gear 15 is urged away from the clutch gear 16 with the head portion 17*a* of the bushing 17 held in frictional engagement with the washer 20.

An interval shaft 22 is journaled in the casing 14. A drive gear 23 and a cam 24 are formed integrally with the interval shaft 22 for rotation therewith. The drive gear 23 meshes with the clutch gear 15. The rotation of a motor (not shown in FIG. 2) is transmitted to the cam 24 through the reduction gear train 11 and the gears 16, 15 and 23. The cam 24 has a cam surface with which one of electrical contact plates 25 engages. When the motor is driven, the cam 24 is rotated at a constant speed with the contact plate slidingly moving along the cam surface to switch electrical current after a preset time interval in the well known manner.

For setting a time interval, the interval shaft 22 is angularly moved about its axis so that the drive gear 23 and the cam 24 are also angularly moved therewith. At this time, the clutch gear 15 in mesh with the drive gear 23 is angularly moved relative to the bushing 17, with the annular flange 15*c* and the bottom of the bore 15*a* frictionally moving relative to the resilient member 21 and the washer 20, respectively. At this time, the clutch gear 16 remains stationary. Thus, the slip friction clutch or resilient member 21 serves to disconnect the clutch gears 15 and 16 so that the rotation of the interval shaft 22 is not transmitted to the motor.

When the motor is energized, the motor drives the cam 24 through the reduction gear train 11 and the gears 16, 15 and 23. The cam 24 is angularly moved about the interval shaft 22 and is returned to its initial position after the preset time interval whereupon the connection of the contact plates 25 is switched to de-energize the motor and to deliver electrical current to an associated load or to interrupt such electrical current. Thus, during the rotation of the motor, the slip friction clutch or resilient member 21 advantageously connects the clutch gears 15 and 16 together to transmit the rotation of the motor to the cam 24.

By virtue of the provision of the flat resilient member 21, the annular flange 15*c* and the central boss 16*a*, the clutch gears 15 and 16 are disposed closely to each other along the shaft 13. Therefore, the dimension between the opposite surfaces of the clutch gears 15 and 16 is substantially reduced so that the timer switch 10 can be constructed in a compact manner. During the operation of the interval shaft 22 for time setting purposes, the gear 15 is rotated in frictional engagement with the washer 20 and the resilient member 21, no substantial torque is required for operating the interval shaft. In addition, the flat resilient member 21 is of a simple design and therefore can be manufactured at low costs. A reduction gear means may be interposed between the gears 23 and 15 to reduce the torque required for operating the interval shaft 22.

Figure 3A:
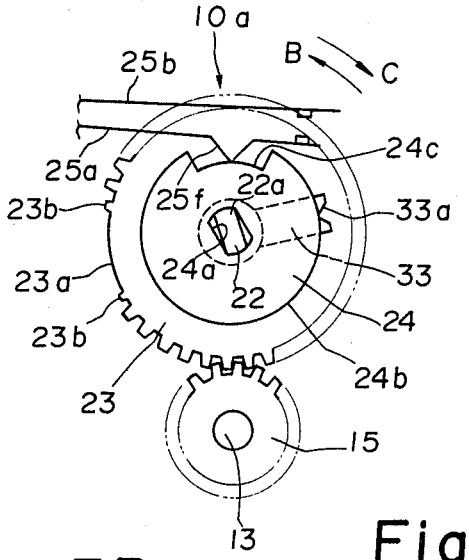
FIGS. 3A to 3C are schematic views of a modified timer switch.
Figure 3B:
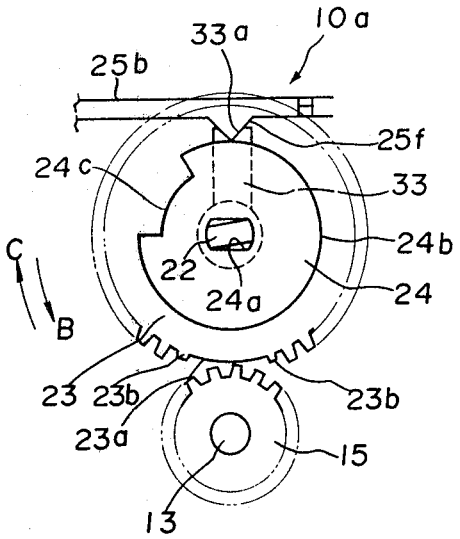

FIGS. 3A to 3B show a timer switch 10*a* according to a second embodiment of the invention. A cam 24 of a generally disc shape has a slot 24*a* formed through its central portion, the slot having arcuate ends. An interval shaft 22 has an end portion 22*a* of a generally rectangular cross-section, the end portion having arcuate lateral ends. The cam 24 is mounted on the interval shaft 22 with the end portion 22*a* loosely fitted in the slot 24*a* for permitting a slight angular movement of the cam 24 about the axis of the interval shaft 22. The cam 24 has a cam surface 24*b* at its periphery, and the cam surface 24*b* has a depressed portion 24*c*. A pair of electrical contact plates 25*a* and 25*b* of resilient material are secured at their one ends to the casing in juxtaposed relation, the contact plate 25*a* acting as a cam follower of the cam 24 as described later. An A.C. power source 30, a motor 31, a load 32 and the pair of contact plates 25*a*, 25*b* are electrically connected to provide a circuit as shown in FIG. 4, the motor 31 and the load 32 being connected in parallel with the power source 30. A keeper member 33 is fixedly secured to and extends radially outwardly from the interval shaft 22, the keeper member 33 having a V-shaped notch 33*a* at its outer end. The keeper member 33 is of such a length that the V-shaped notch 33*a* is disposed slightly outwardly of the periphery of the cam 24. The contact plate 25*a* has a V-shaped projection 25*f* which is adapted to be received in the V-shaped notch 33*a* as described later. A drive gear 23 is formed integrally with the interval shaft 22 and is in mesh with a clutch gear 15. The rotation of the motor 31 is transmitted to the cam 24 through a reduction gear train (not shown in FIGS. 3A to 3C), another clutch gear (not shown in FIGS. 3A to 3C), the clutch gear 15 and the drive gear 23, as described above in the first embodiment. Thus, the cam 24 is driven for rotation or angular movement about the interval shaft 22 at a constant speed in a direction indicated by an arrow B in FIGS. 3A to 3C.

Figure 5:
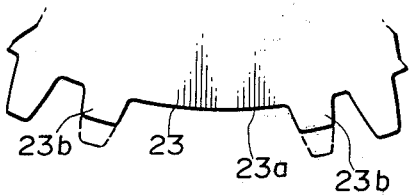
FIG. 5 is an enlarged partial view of a drive gear for the timer switch of FIGS. 3A to 3C.

The gear teeth of the drive gear 23 is partially omitted to provide a smooth portion 23*a*. As best shown in FIG. 5, a pair of gear teeth 23*b*, 23*b* adjacent to the smooth portion 23*a* has a reduced height to facilitate the engagement of the clutch gear 15 with the drive gear 23 as described later. When the gear teeth of the clutch gear 15 is disposed in the smooth portion 23*a* of the drive gear 23, a driving connection between the two gears 15 and 23 is interrupted.

The operation of the timer switch 10*a* will now be described. When the timer switch 10*a* is in its off-state, the contact plate 25*a* is disposed out of engagement with the contact plate 25*b* with the projection 25*f* received in the depressed portion 24*c* of the cam 24, as shown in FIG. 3A.

For continuously driving the load 32, the interval shaft 22 is angularly moved about its axis in the direction B so that the V-shaped notch 33*a* of the keeper member 33 receives the V-shaped projection 25*f* of the contact plate 25*a*, with the gear teeth of the clutch gear 15 disposed in the smooth portion 23*a* of the drive gear 23, as shown in FIG. 3B. In this condition, the contact plate 25*a* is urged into engagement with the contact plate 25*b* to deliver electrical current to the load 32 to drive it. Also, the motor 31 is energized, but since the clutch gear 15 is not coupled in driving relation to the drive gear 23, the drive gear 23, the interval shaft 22 and the cam 24 remain stationary. For switching the timer switch 10*a* to its off-state, the interval shaft 22 is rotated to the position shown in FIG. 3A.

Figure 3C:
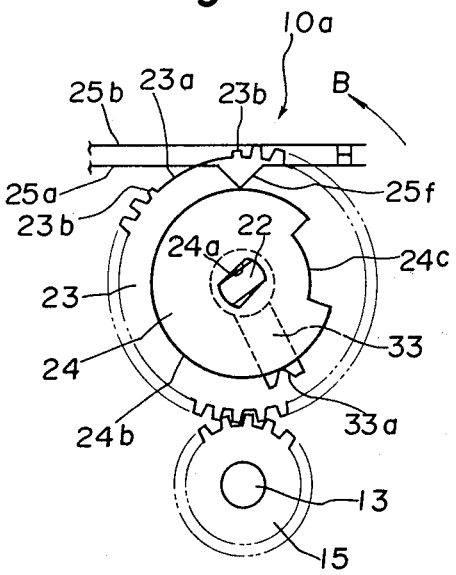
Figure 4:
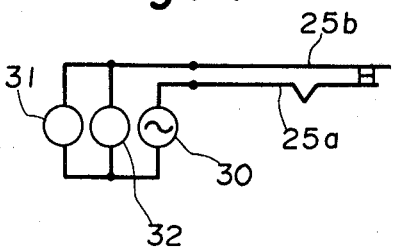
FIG. 4 is a circuit diagram of the timer switch of FIGS. 3A to 3C.

When the load 32 is to be driven for a preset time interval, the interval shaft 22 is angularly moved in the direction C, for example, from the position shown in FIG. 3A to the position shown in FIG. 3C. In this condition, the V-shaped projection 25*f* of the contact plate 25*a* is held in sliding contact with the cam surface 24*b* so that the contact plate 25*a* is urged into engagement with the contact plate 25*b* to power the motor 31 and the load 32. Also, the gear teeth of the clutch gear 15 are in mesh with the gear teeth of the drive gear 23 so that the cam 24 is rotated in the direction B for the preset time interval until the V-shaped projection 25*f* of the contact plate 25*a* drops into the depressed portion 24*c* in the cam surface 24*b* (FIG. 3A) whereupon the motor 31 and the load 32 are deactivated. It will be appreciated that the interval shaft 22 can be rotated in the direction B from the position shown in FIG. 3B to the position shown in FIG. 3C for setting a time interval. At the end of the preset time interval, the V-shaped projection 25*f* of the resilient contact plate 25*a* snaps into the depressed portion 24*c* of the cam surface 24*b* to angularly move the cam 24 slightly relative to the interval shaft 22, since the end portion 22*a* of the interval shaft 22 is loosely fitted in the slot 24*a* of the cam 24. Thus, upon intrusion of the projection 25*f* into the depressed portion 24*c*, the contact plate 25*a* is brought out of engagement from the contact plate 25*b* without delay.

Figure 6:
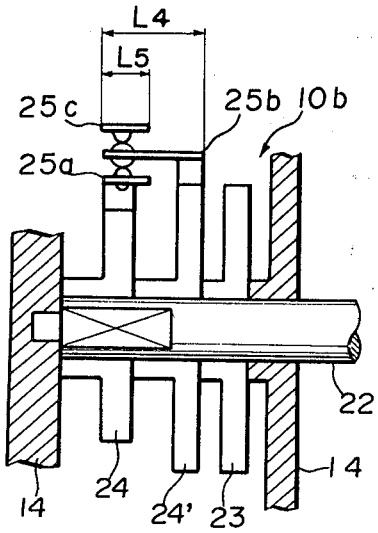
FIG. 6 is a cross-sectional view of another modified timer switch.
Figure 7:
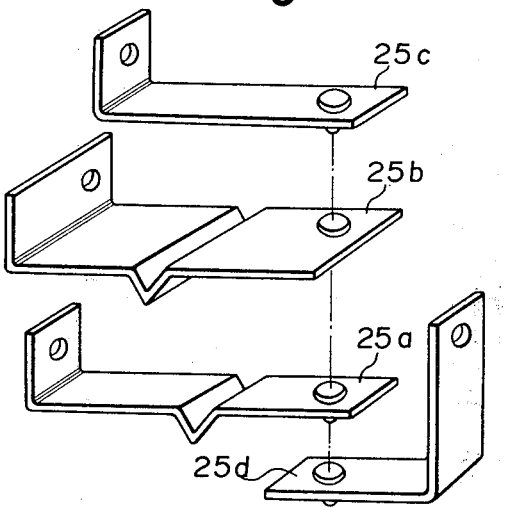
FIG. 7 is a perspective view of a contact plate assembly for the timer switch of FIG. 6.

FIG. 6 shows a timer switch 10*b* according to a third embodiment of the invention. A pair of first and second cams 24 and 24' are mounted on an interval shaft 22 for slight angular movement relative thereto. The two cams 24 and 24' may be of a unitary or one-piece construction. Four electrical contact plates 25*a*, 25*b*, 25*c* and 25*d* of resilient material are secured at their one ends to a casing 14 in juxtaposed relation. As shown in FIGS. 6 and 7, the width L4 of the second contact plate 25*b* is twice the width L5 of the other contact plates 25*a*, 25*c* and 25*d*. The first contact plate 25*a* is held in sliding contact with the peripheral cam surface of the first cam 24 while the second contact plate 25*b* is urged into sliding contact with the peripheral cam surface of the second cam 24'. Thus, the first and second contact plates 25*a* and 25*b* serve as cam followers of the first and second cams 24 and 24', respectively. When the timer switch 10*b* is in its off-state, the first contact plate 25*a* is biased by the first cam 24 in a direction A (FIG. 8) so that the first contact plate 25*a* is urged away from the second contact plate 25*b* into engagement with the fourth contact plate 25*d*. Also, the second contact plate 25*b* is held out of engagement with the third contact plate 25*c*.

Figure 8:
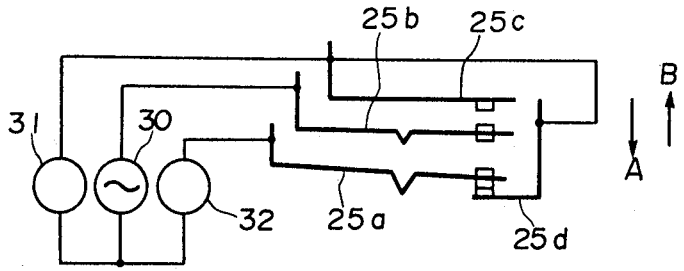
FIG. 8 is a circuit diagram for the timer switch of FIG. 6.

An A.C. power source 30, a motor 31, a load 32 and the four contact plates 25*a* to 25*d* are electrically connected to provide a circuit shown in FIG. 8.

Figure 9:
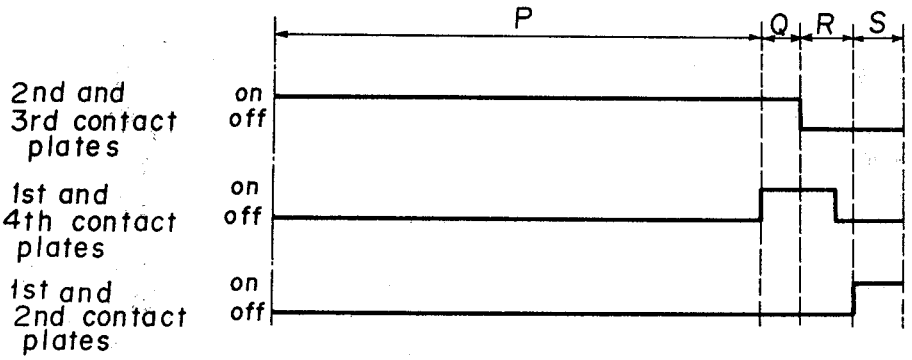
FIG. 9 is a sequence diagram for the timer switch of FIG. 6.

The operation of the timer switch 10*b* will now be described with reference to FIG. 9 in which a sequence diagram of the operation of the timer switch 10*b* is shown. For driving the load 32 for a preset time interval, the interval shaft 22 is angularly moved about its axis through selected degrees so that the second contact plate 25*b* is biased by the second cam 24' in a direction B (FIG. 8) into contact with the third contact plate 25*c* while the first contact plate 25*a* is urged by the first cam 24 in the direction B and held apart from the second contact plate 25*b*. In this condition, the motor 31 is powered to rotate the first and second cams 24 and 24' at a constant speed in one direction. This interval is indicated by reference character P in FIG. 9. After this time interval, the first contact plate 25*a* is biased by the first cam 24 in a direction A (FIG. 8) into contact with the fourth contact plate 25*d* so that the load 32 is powered during a time interval designated at Q in FIG. 9. At this time, a circuit through the second, third, fourth and first contact plates 25*b*, 25*c*, 25*d* and 25*a* and the load 32 is closed (FIG. 8). Then, upon angular movement of the first and second cams 24 and 24' through predetermined degrees, the second contact plate 25*b* is biased by the second cam 24' in the direction A out of engagement with the third contact plate 25*c* so that the motor 31 is de-energized to stop the rotation of the interval shaft 22. Also, the supply of electrical current to the load 32 is interrupted. This condition is designated by reference character R in FIG. 9.

For continuously driving the load 32, the interval shaft 22 is operated to angularly move the first and second cams 24 and 24' into the predetermined positions so that the first contact plate 25*a* is biased by the first cam 24 in the direction B into contact with the second contact plae 25*b* to power the load 32 since a circuit through the second and first contact plates 25*b* and 25*a* and the load 32 is closed. In this condition, the motor 31 is de-energized since the second contact plate 25*b* is held apart from the third contact plate 25*c*. Thus, the first contact plate 25*a* is held in engagement with the second contact plate 25*b* to continuously drive the load 32 for a desired length of time. This condition is indicated by reference character S in FIG. 9. For stopping the continuous operation of the load 32, the interval shaft 22 is angularly moved about its axis into its initial or inoperative position.

Figure 10:
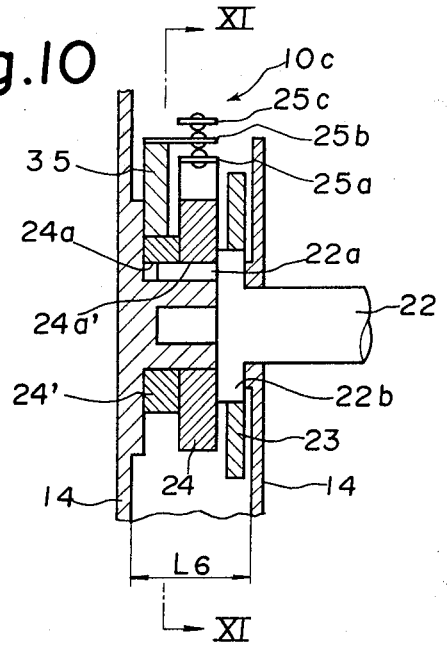
FIG. 10 is a cross-sectional view of a further modified timer switch.
Figure 11:
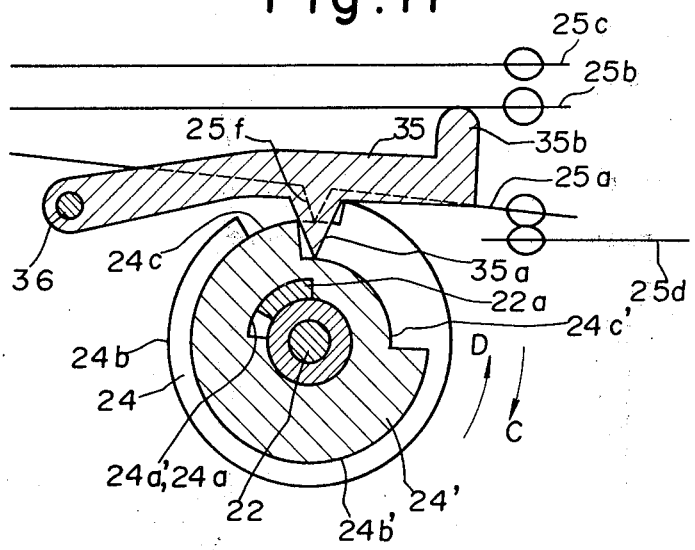
FIG. 11 is a cross-sectional view taken along the line XI—XI of FIG. 10.

FIGS. 10 and 11 show a timer switch 10*c* according to a fourth embodiment of the invention. The timer switch 10*c* differs from the timer switch 10*b* mainly in that a lever 35 is provided. The lever 35 is pivotally mounted at its one end on a casing 14 by a pivot pin 36. As shown in FIG. 11, the lever 35 has intermediate its opposite ends a first projection 35*a* of a V-shaped cross-section disposed in sliding engagement with a peripheral cam surface 24*b'* of a second cam 24', the lever 35 also having at the other end a second projection 35*b* disposed in contact with a second contact plate 25*b*. Thus, the second contact plate 25*b* acts as a cam follower of the second cam 24' through the lever 35. A first cam 24 has a depressed portion 24*c* formed in its peripheral cam surface 24*b* while the second cam 24' has a depressed portion 24*c'* formed in its peripheral cam surface 24*b'*. An interval shaft 22 rotatably extends through the first and second cams 24 and 24' at their centers, the interval shaft 22 has a lug 22*a* of an arcuate shape formed of its one end. The first and second cams 24 and 24' have arcuate slots 24*a* and 24*a'*, respectively, which are disposed adjacent to the interval shaft 22. The arcuate lug 22*a* is complementary in shape to the arcuate slots 24*a* and 24*a'* but has a reduced dimension in the circumferential direction. The arcuate lug 22*a* is fitted in the arcuate slots 24*a* and 24*a'*. This permits a slight angular movement of the first and second cams 24 and 24' relative to the interval shaft 22. The interval shaft 22 has a flange 22*b* which cooperates with the casing 14 to prevent the displacement of the first and second cams 24 and 24' along the interval shaft 22. A drive gear 23 is formed integrally with the interval shaft 22 and is in mesh with a clutch gear (not shown) as described above for the preceding embodiments.

The operation of the timer switch 10*c* will now be described. FIG. 10 shows the timer switch 10*c* in its off-state. For driving the load 32 for a preset time interval, the interval shaft 22 is angularly moved about its axis in a direction C (FIG. 11) through selected degrees so that the cam surface 24*b'* of the second cam 24' urges the lever 35 upwardly to bias the second contact plate 25*b* into engagement with the third contact plate 25*c* through the lever 35. Also, the first contact plate 25*a* is held apart from the fourth contact plate 25*d* by the cam surface 24*b* of the first cam 24. In this condition, the motor 31 is driven to angularly move the first and second cams 24 and 24'. Then, upon angular movement of the first and second cams 24 and 24' through predetermined degrees, the V-shaped projection 25*f* of the resilient first contact plate 25*a* drops into the depressed portion 24*c* of the first cam 24 under its own restoring force so that the first contact plate 25*a* is brought into engagement with the fourth contact plate 25*d* whereupon the load 32 is powered. Then, upon further angular movement of the first and second cams 24 and 24' through predetermined degrees, the V-shaped projection 35*a* of the lever 35 drops into the depressed portion 24*c'* of the second cam 24' so that the second contact plate 25*b* is brought out of engagement with the third contact plate under its own restoring force whereupon the motor 31 and the load 32 are de-energized.

For continuously driving the load 32, the interval shaft 22 is angularly moved about its axis in a direction D (FIG. 11) through predetermined degrees so that the cam surface 24*b* of the first cam 24 urges the first contact plate 25*a* away from the fourth contact plate 25*d* and then into engagement with the second contact plate 25*b* so that the load 32 is powered. The thickness $L_6$ of the interior of the casing 14 is substantially reduced, for example, to 10 mm (FIG. 10).

Figure 12:
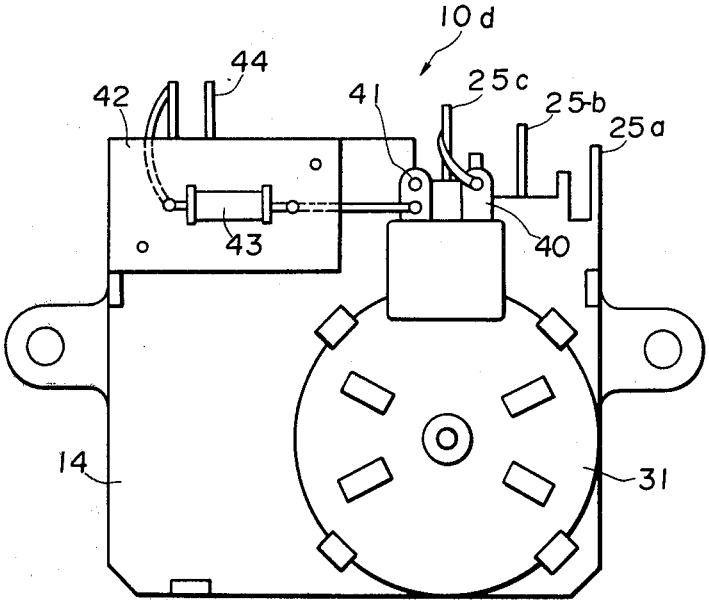
FIG. 12 is a plan view of a further modified timer switch.
Figure 13:
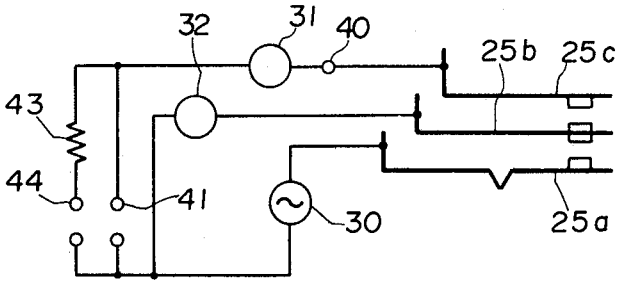
FIG. 13 is a circuit diagram for the timer switch of FIG. 12.

FIGS. 12 and 13 show a timer switch 10*d* according to a fifth embodiment of the invention in which either of low voltage and high voltage power source can be used for operating the timer switch 10*d*. A timer motor 31 is mounted on a casing 14. The rated voltage of the motor 31 is, for example, 100 V. A pair of terminals 40 and 41 are electrically connected to the opposite ends of the winding of the motor 31. Mounted on the casing 14 is an insulating plate 42 on which a resistor 43 is mounted. The terminal 41 is electrically connected to a terminal 44 via the resistor 43. Although not shown in the drawings, a cam of a disc shape is mounted within the casing 14 and is driven for rotation by the motor 31. Three contact plates 25*a*, 25*b*, 25*c* of resilient material are also mounted on the casing and act as cam followers of the cam as described above for the preceding embodiments. As shown in FIG. 13, the first contact plate 25*a* is connected to one terminal of an A.C. power source 30, and the second contact plate 25*b* to a load 32, and the third contact plate 25*c* to the terminal 40 of the motor 31. Either the terminal 41 of the motor 31 or the terminal 44 is adapted to be selectively connected to the other terminal of the power source 30. By rotating the cam, the three contact plates 25*a*, 25*b*, 25*c* are brought into engagement with one another so that the motor 31 and a load 32 are energized. After a preset time interval, the three contact plates are brought out of engagement with one another so that the motor 31 and the load 32 are de-energized. Also, by manually rotating the cam into a predetermined position, the first contact plate 25*a* is held in engagement with the second contact plate 25*b* for a desired length of time for continuously driving the load 32. In this condition, the motor 31 is de-energized.

When a low voltage power source is to be used for operating the timer switch 10*d*, the terminal 41 of the motor 31 is connected to the other terminal of the power source 30. Alternatively, when a relatively high voltage power source is to be employed for operating the timer switch 10*d*, the terminal 44 is connected to the other terminal of the power source 30. With this arrangement, the following formula is obtained:

$$R = E/i - Z$$

wherein R represents the resistance value of the resistor 43, i represents electrical current flowing through the winding of the motor 31, E represents the voltage of the power source 30, and Z represents the impedance of the winding of the motor 31. In the case of the use of the low voltage power source, the motor 31 is connected directly, i.e., not via the resistor 43, to the power source 30. And, where Z is 8300Ω and the voltage of the power source 30 is 100 V, i is 12 mA from the above formula. On the other hand, in the case of the use of the high voltage power source, the motor 31 is connected through the resistor 43 to the power source 30. And, where the voltage of the power source 30 is 200 V, the required value R of the resistor 43 is about 8300Ω to meet the above formula. It will be readily appreciated that the power source 30 of any voltage can be used by varying the value of the resistor 43.

Figure 14:
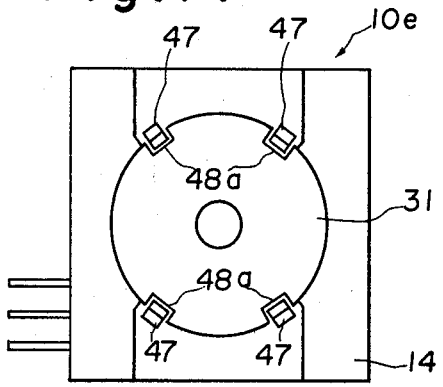
FIG. 14 is a plan view of a further modified timer switch.
Figure 15:
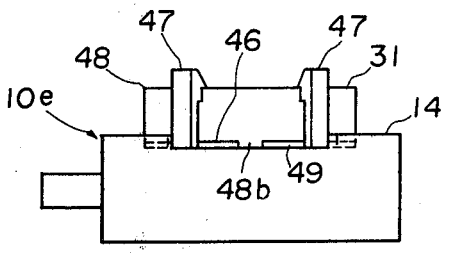
FIG. 15 is a side elevational view of the timer switch of FIG. 14.
Figure 16:
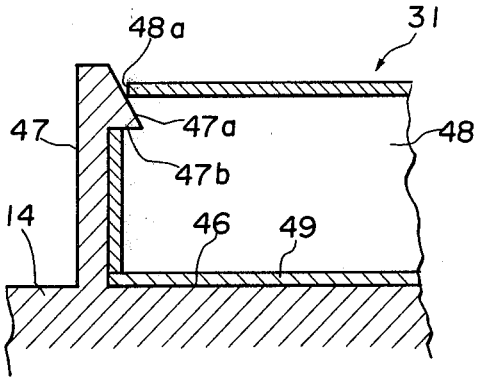
FIG. 16 is a fragmentary cross-sectional view of the timer switch of FIG. 14.

FIGS. 14 to 16 show a timer switch 10*e* according to a sixth embodiment of the invention. A casing 14 of the timer switch 10*e* has a flat mounting surface 46 on which a motor 31 is mounted, the casing 14 being made of a suitable synthetic resin. A plurality of retaining posts 47 are formed integrally with the casing 14 and extend perpendicularly from the mounting surface 46. The retaining posts 47 are elastic and are capable of deformation in a direction transverse to its longitudinal axis. Each of the retaining posts 47 has a claw 47*a* of a wedge-shape at its free end. The face 47*b* of the claw 47*a* directed toward the mounting surface 46 is disposed parallel thereto. A casing 48 of the motor 31 is of a circular shape and has an open bottom, the casing 48 being made of metal. A circular lid 49 is attached to the open bottom of the motor casing 48. The motor casing 48 has a plurality of apertures 48*a* formed through its upper portion. The motor casing 48 also has a plurality of tabs 48*b* formed on the lower edge thereof. The lid 49 is secured to the motor casing 48 by deforming or staking the tabs 48 into positive engagement with the lid 49. The motor casing 48 with the lid 49 is mounted on the mounting surface 46 with the lid 49 disposed in contact thereto. In this condition, the claws 47*a* of the retaining posts 47 are received in the respective apertures 48*a* of the motor casing, and the retaining posts 47 are held against the side wall of the motor casing 48. Thus, the motor casing 48 is held against movement. For mounting the motor casing 48 on the casing 14 of the timer switch 10*e*, the motor casing 48 is positioned with the periphery of the lid 49 in contact with the wedge-shaped claws 47*a* of the retaining posts 47. Then, the motor casing 48 is forced toward the mounting surface 46 so that the retaining posts 47 are elastically deformed outwardly. Upon engagement of the lid 49 with the mounting surface 46, the claws 47*a* are caused to be snappingly fitted in the apertures 48*a* under the restoring action of the elastic retaining posts 47. In this condition, the face 47*b* of each claw 47*a* is held against the edge of the aperture 48*a*, as shown in FIG. 16, to positively retain the motor casing 48 in place. Thus, the motor casing 48 can be easily and quickly mounted on the casing 14 of the timer switch 10*e* without the need for fastening means such as screws.

Figure 17:
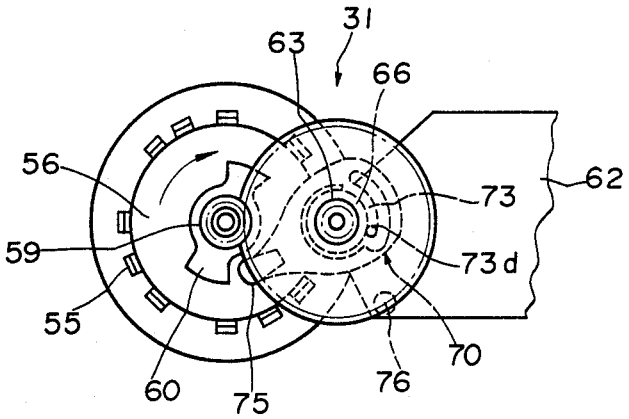
FIG. 17 is a schematic view of a synchronous motor used in the timer switches.
Figure 18:
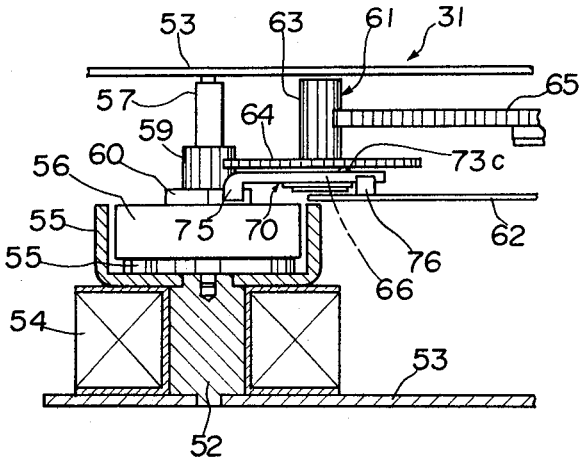
FIG. 18 is a cross-sectional view of the motor of FIG. 17.

FIGS. 17 and 18 show a synchronous motor 31 used in the timer switches in the preceding embodiments. The synchronous motor 31 comprises an iron core 52 secured to a casing 53 and a coil 54 wound around the iron core 52. A rotor 56 is rotatably received in the magnetic poles 55 through a shaft 57 which is formed integrally with the rotor 56 and journalled at their opposite ends in the casing 53 and the core 52. The rotor 56 is in the form of a multi-pole permanent magnet in which a number of poles of alternate north and south polarity are provided around its peripheral portion. The rotor 56 is rotated in synchronism with a rotating magnetic field generated by the magnetic poles 55 of the electromagnetic comprising the core 52 and the coil 54. The shaft 57 has a pinion portion 59 and is disposed in coaxial relation to the rotor 56. The rotor 56 has an elongated engaging portion 60 formed integrally on its surface directed away from the core 52. A gear member 61 is journalled at its opposite ends in the casing 53 and a support plate 62 mounted within the casing 53. The gear member 61 has a pinion 63 and a gear 64 in mesh with the pinion 59. The pinion 63 is in mesh with a gear 65 of a reduction gear train. The gear member 61 also has a shank portion 66 extending in coaxial relation with the pinion 63 in a direction away therefrom.

Figure 19:
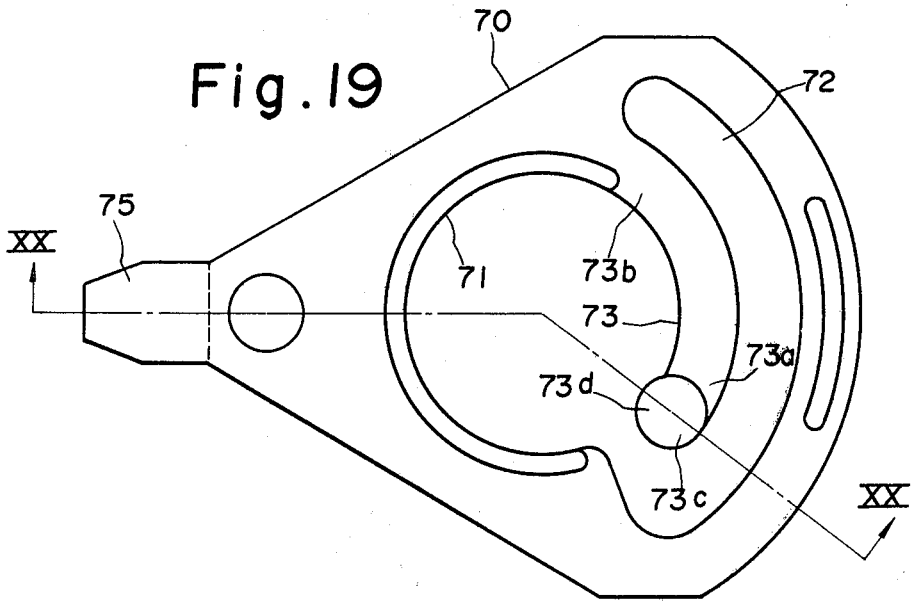
FIG. 19 is a plan view of a retaining plate of the motor of FIG. 17.
Figure 20:
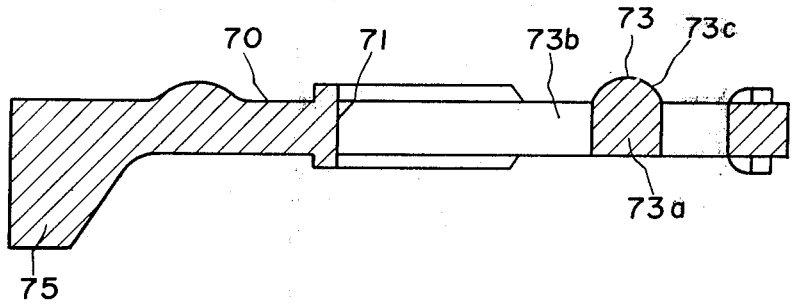
FIG. 20 is a sectional view taken along the line XX—XX of FIG. 19.

A resilient retaining member or plate 70 is rotatably mounted on the shank portion 66 of the gear member 61 and made of a suitable synthetic resin, the retaining member 70 being of a generally sector-shape and being disposed in a plane parallel to the rotor 56. The retaining member 70 has a central circular aperture 71 and an arcuate slot 72 which are spaced by an arcuate arm 73 of the cantilever type disposed therebetween. The arm 73 is interrupted at its one end so that the arcuate slot 72 opens to the central aperture 71 at its one end, as shown in FIG. 19. The shank portion 66 of the gear member 61 extends through the aperture 71. The arcuate arm 73 is so elastic that the arm 73 is deformable both axially and radially of the shank portion 66. The arm 73 has at its one end a first projection 73*c* of a semi-spherical shape formed on its one surface facing the gear 64. Also, the arm 73 has at its one end a second projection 73*d* of a semi-spherical shape formed on its edge facing the shank portion 66 of the gear member 61. The aperture 71 of the retaining member 70 is substantially equal in diameter to the shank portion 66 of the gear member 61. Therefore, the second projection 73*d* frictionally engages the shank portion 66 so that the arm 73 is slightly elastically deformed radially outwardly of the shank portion 66. Also, the first projection 73*c* frictionally engages the surface of the gear 64 facing the retaining member 70 so that the arm 73 is slightly elastically deformed in a direction away from the gear 64. Thus, the retaining member 70 is rotatable with the gear member 61.

The retaining member 70 also has a lug 75 formed at its end remote from the arcuate slot 72 and directed away from the gear 64. As shown in FIG. 18, the end of the lug 75 is disposed in a plane between the surface of the engaging portion 60 and the surface of the rotor 56 facing away from the core 52. When the motor 31 is driven, the lug 75 is capable of intrusion into a circle generated by the opposite end faces of the engaging portion 60 so that one of the opposite ends of the engaging portion 60 is engageable with the lug 75, as will hereinafter more fully described. Secured to the support member 62 is a stop member 76 with which the lug 75 of the retaining member 70 is engageable for limiting the rotation of the retaining member 70.

In operation, the coil 54 is excited to rotate the rotor 56 in a clockwise direction (FIG. 17) so that the gear member 61 is rotated in a counterclockwise direction through the pinion 59 and the gear 64. Upon rotation of the gear member 61, the retaining member 70, which is held in frictional engagement with the gear 64 and the shank portion 66 through the first and second projections 73*c* and 73*d*, is angularly moved in the same direction until the lug 75 is brought into abutting engagement with the stop member 76. The gear member 61 continues to rotate while the retaining member 70 remains stationary. At the initiation of the operation of the motor 31, the rotor 56 may be rotated in a counterclockwise direction (FIG. 17) due to the position of the rotor 56 relative to the magnetic poles 55 and other factors. When the rotor 56 is rotated in a counterclockwise direction (FIG. 17) at the initiation of the operation of the motor 31, the gear member 61 and hence the retaining member 70 are rotated in a clockwise direction, so that the one of the opposite ends of the engaging portion 60 is brought into striking engagement with the lug 75 of the retaining member 70. Upon striking of the one end of the engaging portion 60 against the lug 75, the engaging portion 60 rebounds from the lug 75 so that the rotor 56 is caused to rotate in a reverse direction, i.e., in a clockwise direction (FIG. 17). Thus, the retaining member 70 ensures that the rotor 56 can be rotated in the predetermined direction.

As described above, the curvature of the shank portion 66 of the gear member 61 is substantially equal to the curvature of the inner edge of the arcuate arm 73. Therefore, the second projection 73*d* is positively held in frictional engagement with the shank portion 66 with a substantial portion of the edge of the aperture 71 held slightly apart from the shank portion 66. Also, the first projection 73*c* is positively held in frictional engagement with the gear 64 with the retaining member 70 held apart therefrom. With this construction, a sufficient frictional force can be provided between the retaining member 70 and the gear member 61. In addition, only the first and second projections 73*c* and 73*d* are subjected to wear, and the retaining member 70 can properly function for a prolonged period of time.

The first projection 73*c* may be provided on the other portion of the retaining member 70 than the arcuate arm 73, so as to frictionally engage the gear 64. Also, instead of the first projection 73*c*, a plurality of projections of a semi-spherical shape may be provided on the retaining member 70 so as to frictionally engage the surface of the gear 64 facing the retaining member 70. Also, the second projection 73*d* may be omitted.

What is claimed is:

1. Apparatus which comprises:

(a) a casing;

(b) an electric motor mounted on said casing;

(c) an interval shaft mounted on said casing for rotation about its axis;

(d) a cam of a generally disc-shape mounted on said interval shaft for rotation therewith;

(e) an electrical switching means for switching electrical current including a plurality of resilient contact plates mounted on said casing, said cam acting on at least one of said contact plates;

(f) a drive gear fixedly secured to said interval shaft for rotation therewith;

(g) a bushing rotatably mounted on said casing and having an axis of rotation disposed adjacent to said interval shaft in parallel relation thereto;

(h) a first clutch gear rotatably mounted on said bushing, said first clutch gear being in mesh with said drive gear and having an annular flange;

(i) a second clutch gear fixedly mounted on said bushing for rotation therewith, said second clutch gear being disposed in closely spaced opposed relation to said first clutch gear and being operatively connected to said motor, and said second clutch gear having a central circular boss; and (j) a slip friction clutch comprising a flat resilient plate, said slip friction clutch being mounted on said bushing and interposed between said opposed first and second clutch gears, said central boss being disposed within said annular flange in concentric relation thereto to thereby deform said slip friction clutch into an arcuate cross-section so that said central boss and said annular flange frictionally engage opposite sides of said slip friction clutch, respectively, and said slip friction clutch urging said first clutch gear away from said second clutch gear into frictional engagement with said bushing;

(k) whereby upon rotation of said interval shaft, said first clutch gear is rotated independently of said second clutch gear, frictionally moving relative to said slip friction clutch and said bushing whereas upon rotation of said motor, said slip friction clutch connects said first and second clutch gears for rotation in unison.

2. Apparatus according to claim 1, in which said first clutch gear has a bore opening away from said second clutch gear, said bushing extending through said first clutch gear and having a head portion of an enlarged diameter which is received in said bore of the first clutch gear and frictionally engaged with the bottom of said bore to limit the movement of said first clutch gear away from said second clutch gear.

3. Apparatus according to claim 1, in which said slip friction clutch is of a disc-shape, engages said annular flange at a location space apart from the periphery of said clutch, and engages said central boss at a location spaced farther apart from the periphery of said clutch.

4. Apparatus according to claim 1, in which said cam has a cam surface at its periphery, said cam surface having a depressed portion, said electrical switching means comprising a pair of juxtaposed first and second contact plates mounted at their one ends on said casing, said first contact plate being biased normally into sliding engagement with said cam surface to be engaged with said second contact plate to energize said motor, said first contact plate being biased out of engagement with said second contact plate when said first contact plate drops into said depressed portion of said cam surface, said interval shaft having a keeper member extending radially outwardly therefrom beyond the periphery of said cam, said keeper member being engageable with said first contact plate for biasing it into engagement with said second contact plate, said drive gear having at its periphery a smooth portion which interrupts the peripheral gear teeth thereof, and the gear teeth of said first clutch gear being disposed in said smooth portion of said drive gear to interrupt the driving connection therebetween.

5. Apparatus according to claim 4, in which said drive gear has a pair of gear teeth adjacent to said smooth portion to facilitate the meshing engagement of said first clutch gear with said drive gear.

6. Apparatus according to claim 4, in which said cam is mounted on said interval shaft for slight angular movement relative thereto so that upon intrusion of said first contact plate into said depressed portion, said cam is urged by said first contact plate to angularly move slightly relative to said interval shaft, thereby bringing said first contact plate out of engagement with said second contact plate without delay.

7. Apparatus according to claim 4, in which said keeper member has a V-shaped notch, said first contact plate having a V-shaped projection disposed normally in sliding contact with said cam surface, said V-shaped notch being engageable with said V-shaped projection.

8. Apparatus according to claim 1, in which said cam has a pair of first and second cam surfaces at its periphery, said electrical switching means comprising first, second, third and fourth contact plates mounted at their one ends on said casing in juxtaposed relation, the third contact plate being greater in width than the other three contact plates, said first and second cam surfaces acting on the second and third contact plates, respectively, the third contact plate being selectively brought by said second cam surface into and out of engagement with the fourth contact plate, and the second contact plate being selectively brought by said first cam surface into engagement with one of the first and third contact plates.

9. Apparatus according to claim 8, further comprising a load and power source, in which the second contact plate is electrically connected to one terminal of the load, the third contact plate being electrically connected to one terminal of the power source, the fourth contact plate being electrically connected to said motor, the other terminals of the load, the power source and the motor being connected together, the load and said motor being connected in parallel with the power source through the contact plates, and the first and fourth contact plates being electrically connected together.

10. Apparatus according to claim 9, in which said interval shaft is rotated to a predetermined position so that only the second and third contact plate are engaged together to drive the load whereas said motor is de-energized.

11. Apparatus according to claim 8, in which a lever is pivotally mounted on said casing, said lever being in sliding contact with said second cam surface and acting on the third contact plate.

12. Apparatus according to claim 1, in which a resistor is connected between one end of a winding of said motor and a terminal element, either the one end of the motor winding or said terminal element being selectively connectable to one terminal of a power source, the power souce having another terminal connectable to the other end of the motor winding through said electrical switching means.

13. Apparatus according to claim 1, in which said motor includes a casing having a side wall, an open bottom and a lid fixedly secured to said motor casing to cover the open bottom, said motor casing having a plurality of apertures formed through the side wall thereof, said motor casing being mounted on a flat mounting surface of said casing of said apparatus with said lid held in contact with said mounting surface, a plurality of elastic retaining posts extending outwardly from said mounting surface, said retaining posts being elastically deformable outwardly, each of said retaining posts having a claw at its free end, said retaining posts being held in contact with the side wall of said motor casing with said claws respectively engaging the apertures of said motor casing to hold said motor casing against movement.

14. Apparatus according to claim 1, in which said motor is a synchronous motor which comprises a rotor having an egaging portion formed integrally on one surface thereof and an integral shaft rotatably supported within a casing, said shaft having an integral pinion portion disposed in coaxial relation thereto; a support member mounted within the motor casing; a gear member rotatably supported between the casing and said support member, said gear member having a gear in mesh with said pinion portion and a shank portion disposed between said gear member and said support member; a stop member mounted on said support member; and a resilient retaining plate rotatably mounted on said shank portion, said retaining plate having a projection formed on its one surface facing said gear, said retaining plate being urged toward said gear member so that said projection is in frictional engagement with said gear to cause said retaining plate to rotate together with said gear member, and said retaining plate having a lug formed on its surface facing away from said projection, said retaining plate being brought into engagement with said stop member and prevented from rotation when said rotor is rotated in one direction; when said rotor is rotated in the opposite direction, said retaining plate being rotated together with said gear member through said projection so that said lug is brought into striking engagement with said engaging portion of said rotor whereupon said engaging portion rebounds from said lug to cause said rotor to rotate in the one direction.

15. Apparatus according to claim 14, in which said retaining plate is of a generally sector-shape, said retaining plate having a central aperture and an arcuate slot which are spaced by an arcuate arm disposed therebetween, said arm being interrupted at its one end so that said arcuate slot opens to said central aperture, said shank portion rotatably extending through said central aperture, said central aperture being substantially equal in diameter to said shank portion, said arm being elastically deformable both axially and radially of said shank portion, said projection being formed on said arm, said arm having an edge facing said shank portion, a second projection being formed on its edge facing said shank portion and frictionally engaging therewith so that said arm is slightly elastically deformed radially outwardly of said shank portion.

* * * * *